United States Patent [19]

Glassman

[11] Patent Number: 4,896,657

[45] Date of Patent: Jan. 30, 1990

[54] EXHAUST HOOD SYSTEM AND METHOD FOR PIZZA OVENS

[76] Inventor: Joseph T. Glassman, 303 W. 38th St., Hays, Kans. 67601

[21] Appl. No.: 356,765

[22] Filed: May 25, 1989

[51] Int. Cl.[4] ..... F24C 15/20

[52] U.S. Cl. ..... 126/299 D

[58] Field of Search ..... 55/DIG. 36; 98/115.1; 126/299 R, 299 D

[56] References Cited

U.S. PATENT DOCUMENTS

| | | | |
|---|---|---|---|
| 3,530,784 | 9/1970 | Courchesne | 126/299 D |
| 3,978,777 | 9/1976 | Hett | 126/299 D |
| 4,541,409 | 9/1985 | Karst et al. | 126/299 D |
| 4,556,046 | 12/1985 | Riffel et al. | 126/299 D |

*Primary Examiner*—Harold Joyce

*Attorney, Agent, or Firm*—Kokjer, Kircher, Bradley, Wharton, Bowman & Johnson

[57] ABSTRACT

An exhaust hood for a pizza oven which induces exhaust materials into the exhaust stream by creating high velocity flow of outside air in the hood. An intake fan forces outside air into a central intake plenum having a restricted throat. An air deflector in the throat presents two oppositely directed slots creating high velocity air streams in opposite directions. Exhaust plenums on opposite sides of the hood receive the air and the entrained exhaust materials from the oven. An exhaust fan draws air into the exhaust plenums through inclined grease filters.

20 Claims, 1 Drawing Sheet

EXHAUST HOOD SYSTEM AND METHOD FOR PIZZA OVENS

BACKGROUND AND SUMMARY OF THE INVENTION

This invention relates in general to the field of exhaust hoods and more particularly to a method and system for exhausting heat and vapors generated by pizza ovens.

The pizza ovens which are used in the food industry to cook pizzas generate considerable heat and also create grease laden air, smoke and vapors, all of which must be exhausted from the building. Typically, an exhaust hood of some kind is installed above the pizza oven and equipped with an exhaust fan which operates to exhaust the heat and vapors that enter it. Conventional pizza oven hoods effect a front to back flow of air which is somewhat inefficient because the rising heat and vapor must be abruptly churned through a right angle in the hood. Furthermore, the flow pattern can be disrupted by local areas of turbulence which can reduce the efficiency and effectiveness of the exhaust system.

The volume of air that is exhausted from within the building by the exhaust hood must be made up by other air handling equipment. Thus, in the winter, the furnace must be operated to heat the air which serves as make up air to replace the volume that is exhausted by the pizza oven hood. Conversely, the air which is drawn into the building to replace the air that is exhausted in the summertime must be cooled by the air conditioning system of the building. In both cases, there are added energy demands on the air handling equipment, and these lead to significant additional costs.

The present invention is directed to an improved exhaust hood system which overcomes many of the aforementioned problems associated with conventional pizza oven hoods. In accordance with the invention, a specially constructed pizza oven hood has a central intake plenum which extends above the pizza oven from front to back. Outside air is forced into the intake plenum by an intake fan. A baffle in the intake plenum deflects the incoming air toward and along the plenum walls toward a restricted throat portion of the plenum. A special air deflector in the throat area of the plenum forms two slots through which the air passes in opposite directions toward the opposite sides of the hood.

It is an important feature of the invention that the intake system provides two oppositely flowing air streams which travel at a relatively high velocity from the center of the hood toward the opposite sides. This high velocity air flow creates a suction effect which induces heat, smoke, vapors and grease laden air into the hood for entrainment with the air streams. The hood includes exhaust plenums at its opposite sides and an exhaust fan which draws air from the hood through inclined grease filters and into the exhaust plenums and then out of the building through suitable exhaust ducts.

This construction provides an efficient exhaust system which operates by induction to draw heat and vapors from the oven into the hood where entrainment with the incoming air carries the heat and vapors out through the exhaust side of the system. The intake system creates this induction effect as a result of the high velocity air flow from the slots, and the hood is arranged so that the air flow pattern is symmetrical and covers the entire area of the pizza oven, thus avoiding areas of turbulence and other flow disruptions. At the same time, the volume of the make up air that enters through the intake system is carefully controlled in order to avoid unduly adding to the load of the existing air handling equipment of the building.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
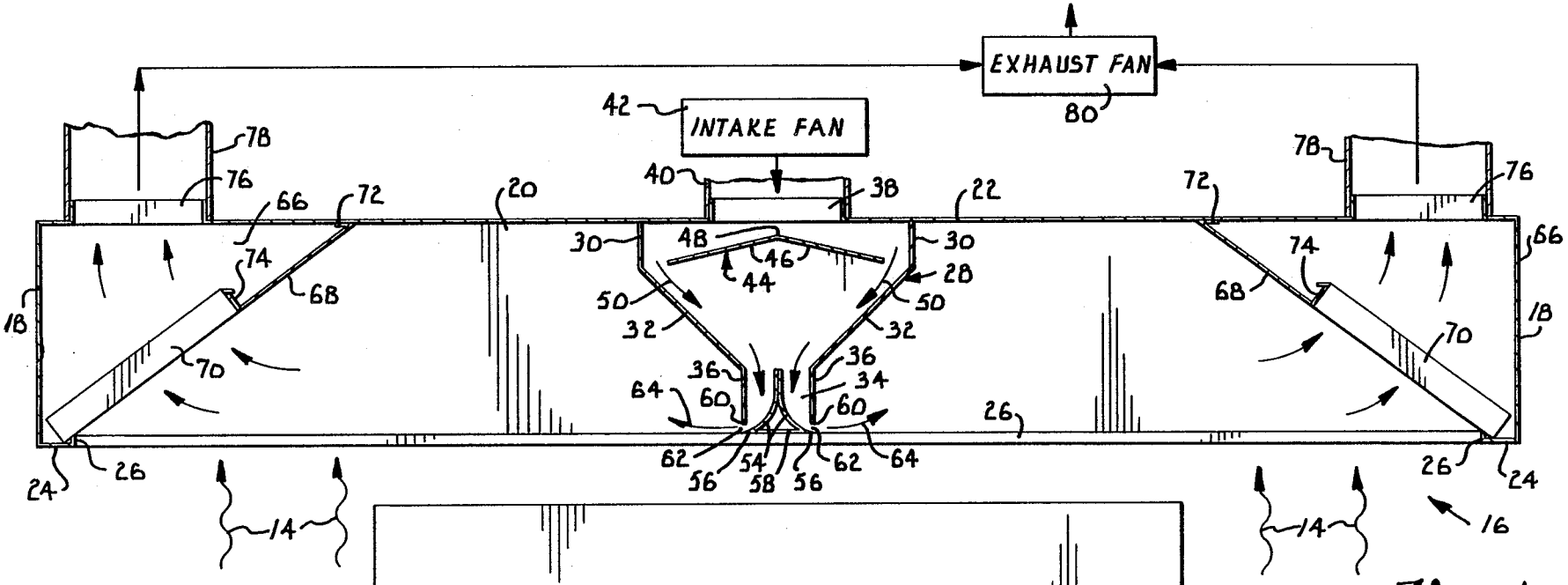
FIG. 1 is a sectional view taken on a vertical plane through a pizza oven exhaust hood constructed according to a preferred embodiment of the present invention.
Figure 2:
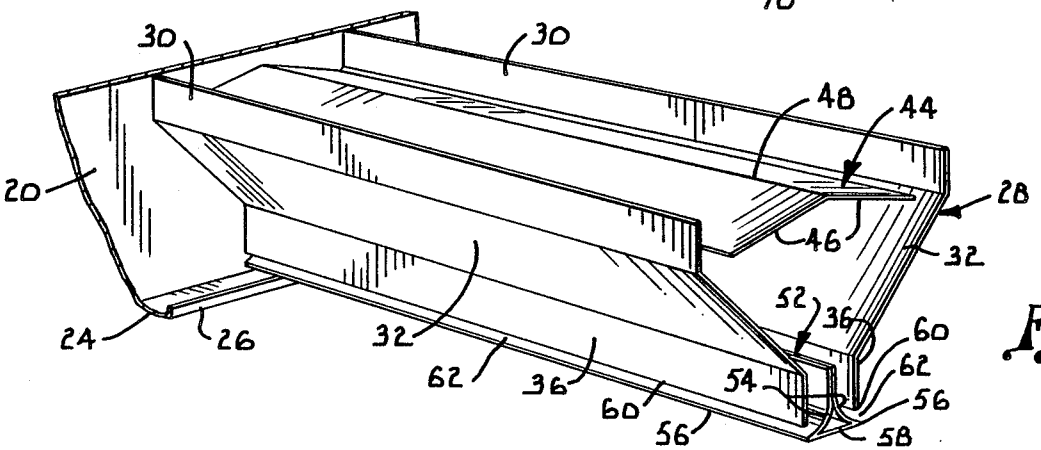
FIG. 2 is fragmentary perspective view, partially in section, depicting the intake plenum of the exhaust hood shown in FIG. 1.

Referring now to the drawings in more detail, numeral 10 designates a pizza oven which may be a conventional oven of the type used in the food industry to cook pizzas in restaurants, carry out facilities and other places where pizza is cooked. The oven 10 has opposite sides 12 from which heat, grease laden air, smoke, fumes, and vapors are discharged from the oven, as identified collectively by the arrows 14.

In accordance with the present invention, an overhead exhaust hood which is generally identified by numeral 16 is mounted above the pizza oven 10. The hood 16 is generally open at the bottom and includes opposite side panels 18, opposite end panels 20 and a top panel 22 which is connected to the side panels 18 and end panels 20. The side panels 18 are normally parallel to one another, as are the end panels 20. The top panel 22 is normally horizontal. The side panels 18 and end panels 20 may be mounted in any suitable manner to the walls or other structure in the room which contains the pizza oven 10. The lower edges of the side panels 1B and end panels 20 are provided with inwardly turned flanges 24, and each flange 24 has an upturned lip 26 on its inner edge. As shown in FIG. 1, the side to side dimension of the hood 16 between the side panels 18 should be considerably greater than the side to side dimension of the pizza oven 10 between its opposite sides 12.

The hood 16 is provided with an intake plenum 28 which is located substantially midway between the opposite side panels 18 and which extends between and is suitably mounted to the opposite end panels 20. The intake plenum is preferably a hopper-shaped structure having its opposite sides a pair of short, parallel upper wall sections 30 which extend downwardly from the top panel 22. Inclined panels 32 on the opposite sides of plenum 28 extend downwardly and inwardly from the wall sections 30 in converging relationship to one another. A restricted throat 34 is formed at the bottom portion of the plenum 28 between a pair of parallel panels 36 which extend downwardly from the lower edges of the incline panels 32. The throat 34 is open at the bottom and terminates near the bottom of the hood 16.

The plenum 28 has an intake opening 38 which extends through the top panel 22 and which may be of any suitable shape. The intake 38 is connected with an intake duct 40 having a complementary shape. An intake fan 42 which may be a conventional electrically powered fan draws in outside air and forces the air into the intake duct 40 and through the intake opening 38 into the top of the plenum 28.

A baffle 44 is provided in the intake plenum 28 and extends along the entire length of the plenum. The baffle 44 is a wing shaped structure having a pair of baffle sections 46 on its opposite sides which incline downwardly from an apex 48 of the baffle. The apex 48 is centered below the intake opening 38 and is centered transversely on the plenum 28. The baffle sections 46 terminate in free edges which are spaced inwardly from the intersections between the panels 30 and 32 on opposite sides of the plenum 28. The incoming air which enters the plenum through the intake 38 is thus deflected by the baffle 44 toward the opposite sides of the plenum and is caused to flow generally downwardly along the panels 32 in substantially equal amounts, as indicated by the directional arrows 50 in FIG. 1.

The throat 34 of the intake plenum is provided with an air deflector 52. The air deflector 52 includes a pair of curved deflection surfaces 54 which are joined at their upper portions at the transverse center of the throat 34. The deflection surfaces 34 curve outwardly in opposite directions as they extend downwardly within the throat 34, and each deflection surface terminates in a lip 56 which is formed at the intersection between the deflection surface 54 and a flat bottom panel 58 of the air deflector 52. The air deflector 52 extends the entire length of the plenum 28 and may rest and be secured at its opposite ends on the lips 26 on the opposite end walls 20 of the hood.

Each side panel 36 of the throat 34 terminates in a free edge 60 which is spaced a short distance directly above the corresponding lip 56 of the air deflector 52. The spaces which are thereby formed between the respective lips 56 and edges 60 define elongated horizontal slots 62 which extend the entire length of the intake plenum 28. The slots 62 are oriented to discharge the air passing through them in a generally horizontal direction, with the two slots directing the air in opposite directions toward the opposite side panels 18 of the hood. The small width of each slot 62 creates a relatively high velocity flow of the air that passes through the slots in opposite directions, and the high velocity air streams that are created by the slots are identified by the directional arrows 64 in FIG. 1.

Each of the opposite sides of the hood 16 is provided with an exhaust plenum 66. Each plenum is generally triangular and is formed in part by the adjacent side panel 18, in part by the overlying portion of the top panel 22, and in part by an inclined panel 68 and a plurality of grease traps 70 located below and forming an extension of the panel 68. Each panel 68 extends the entire length of the hood 16 between the end panels 20. The upper edge of each panel 68 is provided with a flange 72 by which the panel may be connected with the top panel 22 of the hood. The lower edge of each panel 68 is provided with a flange 74 which facilitates connection of the grease traps to the panel. The lower portions of the grease traps 70 rest on the flanges 74 and the lips 26 of the corresponding side panels 18.

The grease traps 70 may be baffled grease traps which permit the flow of air through them and serve to remove grease from the air that passes through them. Preferably, the grease traps 70 may be easily removed, cleaned and replaced. The panels 68 and grease traps 70 are oriented on an incline which can vary in its angle of inclination depending upon the particular application of the hood.

An exhaust outlet 76 is provided for each exhaust plenum 66 and is formed through the top panel 22 above the plenum. The exhaust outlets 76 are thus located adjacent to the opposite side panels 18 of the hood. The outlets 76 may have any suitable configuration and are connected with suitable exhaust ducts 78. An exhaust fan 80 which may be a conventional electrically powered exhaust fan is connected with the exhaust ducts 78 in order to draw air through them and through the exhaust plenums 66.

In use of the hood 16, the intake fan 42 and the exhaust fan 80 are operated simultaneously, with the intake fan forcing fresh outside air into the intake plenum 28 and the exhaust fan 20 operating to exhaust air from the hood through the exhaust plenums 66. The incoming air which enters the intake plenum 28 is forced by baffle 44 to flow toward and along the inclined side panels 32 in substantially equal amounts. The incoming air then enters the throat 34 and is changed in its direction by the smoothly curved deflection surfaces 54 which turn the air flow through an angle of substantially 90 degrees from the vertical direction of the air which enters the throat 34 to a horizontal direction for the air which is discharged from plenum 28 through the two oppositely directed slots 62.

As previously indicated, the slots 62 produce the high velocity air streams 64 which flow toward the opposite sides of the hood, and this high velocity air flow creates low pressure and an induction effect which induces the heat, grease laden air, fumes, smoke and vapors (14) to flow into the hood 16 where they are entrained by the air streams 64. The air streams thus carry the exhaust materials with them through the grease filters 70 and into the exhaust plenums 66 from which they are exhausted from the building through the exhaust ducts 78.

In this manner, the hood 16 sucks the exhaust materials 14 from the pizza oven 10 into the hood to efficiently exhaust them from the building. The hood has a symmetrical configuration which results in a symmetrical air flow pattern on opposite sides of the oven 10, thus assuring that substantially half of the exhaust air flows out through each side of the exhaust system. At the same time, the air flow is smooth at all locations within the hood 16 in order to avoid local disruptions such as local areas of turbulence which can detract from the efficiency of the exhaust system.

The configuration of the intake plenum 28 and the provision of the baffle 44 provide good air distribution along the length of the plenum 28 and create equal flow through the oppositely directed slots 62 along substantially their entire lengths. In addition, because of the inclined orientation of panels 68 and the grease traps 70, the exhaust materials 14 follow a relatively straight path as they enter the exhaust plenums 66, and the absence of abrupt changes in the flow direction minimizes turbulence and other flow disruptions. The intake plenum 28 is preferably centered above the oven 10, and each exhaust plenum 66 is preferably the same distance away from the intake plenum in order to provide balanced flow on opposite sides of the hood system.

The intake and exhaust fans 42 and 80 are preferably balanced horsepower fans adjusted such that the intake fan 42 provides sufficient additional incoming air to make up for or nearly make up for the air that is exhausted from within the room by the exhaust side of the system. Consequently, the air handling equipment of the building is not subjected to a significantly added load as would be the case in the absence of fresh incoming air in the hood system.

The width of each slot 62 may be made adjustable by allowing for up and down movement of the air deflector 52 or by adjustable plates (not shown) mounted to slide up and down on the opposite side panels 36 of the throat 34. This permits the velocity of the air passing through the slots to be adjusted according to the specific conditions that are encountered. Additionally, the angle of incline of the grease filters 70 may be adjustable in order to permit the system to be adjusted according to different applications.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. An exhaust system for a pizza oven, comprising:

an overhead hood mounted above the pizza oven, said hood having opposite sides;

an air intake plenum in said hood at a location between said opposite sides of the hood, said intake plenum presenting a pair of elongated slots oriented to direct air from said plenum toward the respective opposite sides of the hood;

a pair of exhaust openings in said hood for discharging air therefrom, said openings being located adjacent the respective opposite sides of the hood;

exhaust fan means for drawing air through said exhaust openings; and intake fan means for forcing outside air into said intake plenum and through said slots in a pair of air streams traveling at a relatively high velocity to induce heat and vapor from the oven into the air streams and out through said exhaust openings.

2. The exhaust system of claim 1, including:

a restricted throat in said intake plenum; and an air deflector in said throat arranged to form said slots and to direct the aim in said throat toward and through the slots.

3. The exhaust system of claim 2, wherein:

said throat has opposite sides each terminating in an edge, said edges defining the tops of the respective slots; and said deflector presents a pair of lips spaced below the respective edges of said sides of the throat to define the bottoms of the respective slots.

4. The exhaust system of claim 3, including a pair of curved surfaces on said deflector curving in said throat toward the respective lips to gradually turn the air in said throat from a substantially vertical flow direction to a substantially horizontal flow direction from the slots.

5. The exhaust system of claim 4, including:

opposite sides of said intake plenum connected with said opposite sides of the throat; and baffle means in said intake plenum for deflecting incoming air toward the opposite sides of the plenum.

6. The exhaust system of claim 5, wherein said baffle means comprises a baffle having a pair of baffle sections inclining toward the respective opposite sides of the intake plenum.

7. The exhaust system of claim 6, wherein said opposite sides of the intake plenum converge toward said throat.

8. The exhaust system of claim 1, including:

opposite sides of said intake plenum oriented to converge toward said slots; and baffle means in said intake plenum for deflecting incoming air toward said opposite sides of the plenum.

9. The exhaust system of claim 1, including:

a pair of exhaust plenums in said hood adjacent the opposite sides thereof, said exhaust openings communicating with the respective exhaust plenums to exhaust air therefrom; and filter means between said slots and each exhaust plenum for filtering grease from the air entering the exhaust plenums.

10. The exhaust system of claim 9, wherein:

each exhaust plenum includes an inclined panel; and said filter means comprises grease filter elements mounted on said inclined panel of each exhaust plenum.

11. The improvement of claim 1, including an air intake to said intake plenum located substantially midway between the opposite ends of said hood.

12. The improvement of claim 11, wherein each outlet is located substantially midway between the opposite ends of said hood.

13. In an exhaust system for a pizza oven, the improvement comprising:

an overhead hood mounted above the oven, said hood having opposite ends and opposite sides;

an air intake plenum in said hood extending above the over between said opposite ends of the hood, said intake plenum having a throat therein substantially centered between said opposite sides of the hood;

air deflector means in said throat for presenting a pair of elongated slots oriented to direct air passing through the throat in a pair of air streams traveling in opposite directions toward the opposite sides of said hood;

a pair of exhaust plenums adjacent the respective opposite sides of the hood, each exhaust plenum extending between the opposite ends of the hood;

filter means for filtering grease from the air entering each exhaust plenum from the hood;

an outlet for each exhaust plenum for discharging air therefrom;

exhaust fan means for drawing air from each exhaust plenum through the outlet thereof; and intake fan means for forcing outside air into said intake plenum and through said throat to effect a relatively high velocity air flow through said slots, thereby inducing heat and vapor from the oven into said air streams for passage into the exhaust plenums.

14. The improvement of claim 13, wherein:

said throat includes opposite sides; and said air deflector means comprises a pair of deflection surfaces in said throat curving toward the respective opposite sides thereof from top to bottom to turn the air flow direction in the throat from substantially vertical to substantially horizontal at the slots.

15. The improvement of claim 14, wherein:

each side of said throat terminates in an edge; and each of said deflection surfaces presents a lip spaced below the edge of the corresponding side of the throat to thereby define said slots between said edges and lips.

16. The improvement of claim 13, including:

opposite sides of said intake plenum arranged to converge toward said throat; and baffle means in said intake plenum for deflecting incoming air toward and generally along said opposite sides of the intake plenum.

17. The improvement of claim 16, wherein said baffle includes a pair of inclined baffle surfaces which incline downwardly toward the respective opposite sides of the intake plenum.

18. A method of exhausting heat and vapor from a pizza oven, said method comprising the steps of:

directing outside air generally laterally in opposite directions in a pair of air streams which originate above the oven and which travel at a relatively high speed to induce the heat and vapor from the oven into the air streams;

providing a pair of overhead exhaust openings on opposite sides of the oven for receiving and exhausting the respective air streams and the heat and vapor entrained therein by induction; and pulling air and the heat and vapor through said exhaust openings.

19. The method of claim 18, wherein said directing step comprises directing the outside air in a manner to effect a substantially equal volume of air flow in each stream.

20. The method of claim 18, including the step of filtering each air stream at a location upstream from the corresponding exhaust opening to filter grease in the air stream.

* * * * *